United States Patent [19]

Kawabe et al.

[11] Patent Number: 4,762,168

[45] Date of Patent: Aug. 9, 1988

[54] CONDENSER HAVING APPARATUS FOR MONITORING CONDITIONS OF INNER SURFACE OF CONDENSER TUBES

[75] Inventors: Atsushi Kawabe, Sakai; Katsumi Yasui, Nishinomiya; Masaki Yamamoto, Akashi; Koji Nagata, Nisshin; Tetsuro Atsumi, Nagoya; Mamoru Nishikawa, Mie, all of Japan

[73] Assignees: Sumitomo Light Metal Industries, Ltd., Tokyo; The Kansai Electric Power Company, Incorporated, Osaka, both of Japan

[21] Appl. No.: 933,927

[22] Filed: Nov. 24, 1986

[30] Foreign Application Priority Data

Nov. 28, 1985 [JP] Japan ..... 60-267700

[51] Int. Cl.[4] ..... G01N 17/00; F28G 1/12; F28G 9/00

[52] U.S. Cl. ..... 165/11.1; 165/95; 73/61.2; 73/112; 204/404

[58] Field of Search ..... 165/95, 11.1; 210/636, 210/96.2; 73/61.2, 112; 204/404

[56] References Cited

U.S. PATENT DOCUMENTS

| | | | |
|---|---|---|---|
| 3,618,769 | 11/1971 | Iglesias | 210/96.2 |
| 3,788,962 | 1/1974 | Frenck . | |
| 3,913,378 | 10/1975 | Hausler | 73/61.2 |
| 4,044,605 | 8/1977 | Bralthall | 165/11.1 |
| 4,390,058 | 6/1983 | Otake et al. | 165/95 |
| 4,476,917 | 10/1984 | Otake et al. | 165/95 |
| 4,686,853 | 8/1987 | Sugam et al. | 165/11.1 |

FOREIGN PATENT DOCUMENTS

| | | | |
|---|---|---|---|
| 0030459 | 6/1981 | European Pat. Off. . | |
| 0155326 | 9/1985 | European Pat. Off. . | |
| 3125546 | 3/1982 | Fed. Rep. of Germany . | |
| 1087475 | 2/1955 | France . | |
| 2417096 | 9/1979 | France . | |
| 0014193 | 1/1982 | Japan | 165/95 |
| 0015800 | 1/1984 | Japan | 165/95 |
| 8601837 | 3/1986 | World Int. Prop. O. . | |
| 1016361 | 1/1966 | United Kingdom . | |
| 2102945 | 2/1983 | United Kingdom | 165/11.1 |
| 2125171 | 2/1984 | United Kingdom . | |

OTHER PUBLICATIONS

Japanese Patent Abstract 58-208587; vol. 8, No. 57, (M-283), [1494] Mar. 15, 1984.

Japanese Patent Abstract 58-171578; vol. 8, No. 3 (C-203) [1440] Jan. 7, 1984.

"A Method for Determining Corrosion Rates from Linear Polarization Data"; Milton Stern; pp. 60-64.

*Primary Examiner*—Albert W. Davis, Jr.

*Assistant Examiner*—John K. Ford

*Attorney, Agent, or Firm*—Parkhurst & Oliff

[57] ABSTRACT

A condenser including a plurality of condenser tubes through which a coolant is caused to flow, a device for injecting ferrous ions into the coolant before it passes through the condenser tubes to form a protective film on an inner surface of the condenser tubes, and a device for introducing sponge balls into the condenser tubes for cleaning their inner surfaces. The condenser has a by-pass line extending outside the body of the condenser, in parallel connection with the condenser tubes. The by-pass line has a monitor tube of the same material and size as the condenser tubes, so that the coolant flows through the monitor tube under the same conditions as the coolant flowing through the condenser tubes. The monitor tube is equipped with a device for measuring a polarization resistance of the monitor tube, and a device for sensing a fouling condition of the inner surface of the monitor tube. The injection of ferrous ions into the condenser tubes and the cleaning of their inner surfaces with the sponge balls are adjusted in response to the measured or sensed polarization resistance and fouling condition of the monitor tube.

5 Claims, 3 Drawing Sheets

CONDENSER HAVING APPARATUS FOR MONITORING CONDITIONS OF INNER SURFACE OF CONDENSER TUBES

BACKGROUND OF THE INVENTION

1. Field of the Invention

The present invention relates in general to an apparatus for monitoring a condenser for its corrosion resistance and condition of contamination, and more particularly to an apparatus for monitoring a condenser wherein a coolant such as seawater or estuary water is caused to flow through condenser tubes made of a copper alloy, and which is equipped with a ferrous-ion injecting device for injecting ferrous ions into the coolant, which is passed through the condenser tubes, in order to form a protective film on the inner surface of the condenser tubes, and a sponge-ball supply device for introducing sponge balls into the condenser tubes for removing deposits inside the tubes.

2. Discussion of the Prior Art and its Problems

As heat exchange condenser tubes for condensers in thermoelectric or steam power plants, chemical plants, or vessels or ships, there have been widely used special aluminum brass tubes having a composition which consists of brass as a base material, aluminum, arsenic, and other additives such as silicon, or alternatively, copper-alloy tubes such as cupronickel tubes made of copper, nickel, iron and manganese are used as the condenser tubes. Such condensers are adapted such that a coolant such as seawater (interpreted to include bay or estuary water) flows through the condenser tubes, while a high-temperature fluid (usually in its vapor phase) contacts the outer surface of the condenser tubes, whereby a heat exchange occurs beween the coolant and the hot fluid, via the condenser tubes. Since seawater is typically used as the coolant, the condenser tubes suffer from contamination or fouling during a long period of service, due to deposits of various substances on the inner surfaces of the tubes. These substances differ depending upon the nature of the specific seawater used. For example, the inner surfaces of the condenser tubes are subject to deposition of mud and sand or other sludges, iron rusts, corrosion products, and slime. These foreign substances reduce the overall heat transfer coefficient (thermal conduction characteristics) of the condenser tubes, thereby deteriorating the thermal efficiency of the condenser.

In light of the above, the maintenance of the copper alloy condenser tubes of a condenser wherein seawater is used as a coolant has been conventionally accomplished by (a) preventing corrosion of the inner surface of the tubes by the cooling seawater, and (b) preventing deposition or accumulation of various suspended matters and corrosion products on the inner surface of the tubes, and thus avoiding the deterioration of thermal conduction characteristics of the tubes. Described more specifically, it has been found extremely effective to inject ferrous ions in the form of ferrous sulfate into the coolant for protecting the condenser tubes, and to use sponge balls for cleaning the inner surface of the tubes to remove the deposited matters.

While the corrosion resistance of the condenser tubes is remarkably improved by a protective film of ferric hydroxide formed of ferrous ions as a result of injection of ferrous sulfate, for example, it is also known that such a protective film will reduce the thermal conduction characteristics of the condenser tubes. On the other hand, the cleaning of the condenser tubes with sponge balls results in enhancing the heat transfer rate of the tubes, but at the same time may cause a decline in the corrosion resistance of the tubes, if the protective film on the inner tube surface is excessively removed by the sponge-ball cleaning. Thus, there is a general recognition that the ferrous-ion injection and the sponge-ball cleaning are not satisfactorily stable and reliable for maintaining the required corrosion resistance and heat transfer characteristics of the condenser tubes.

In view of the above drawbacks, it has been proposed to inject ferrous ions and introduce sponge balls into the condenser tubes, according to a program which is predetermined based on laboratory tests or field tests, so as to satisfy the two requirements, i.e., corrosion resistance and heat transfer rate of the condenser tubes. The program to carry out the ferrous-ion injection and sponge-ball cleaning is modified or revised as needed, based on the results of periodic inspection of the condenser tubes. Since the nature of the cooling seawater, when used as the coolant is not kept constant during the service of the condenser, i.e., may be considerably varied, the ferrous-ion injection and sponge-ball cleaning according to the predetermined program have not been proved satisfactory for all operating conditions of the condenser, in maintaining the optimum corrosion resistance and heat transfer characteristics of the condenser tubes.

Another method of controlling the ferrous-ion injecting and sponge-ball cleaning operations is to monitor the corrosion resistance and heat transfer characteristics of the condenser tubes by directly measuring the polarization resistance of the condenser tubes which represents the corrosion resistance, and by sensing the cleanliness factor of the inner tube surfaces which represents the heat transfer rate. According to this method, devices for injecting ferrous ions and introducing sponge balls are controlled based on changes in the continuously measured or sensed polarization resistance and cleanliness factor. However, this proposed monitoring method is not practically available, since it has the following drawbacks, in relation to the position of installation of measuring or sensing devices, or the sensing arrangement.

In measuring or detecting the polarization resistance, a measuring device is installed within a water chamber of the condenser. This means that the measured polarization resistance is that of the condenser tubes at their ends open to the water chamber. Therefore, if the condenser tubes are long, for example, 10 m or more, the measurement does not exactly represent the polarization resistance at the substantive portion of the condenser tubes. Further, the measurement is influenced by the polarization resistance of a tube plate disposed to support the condenser tubes at the above-indicated end. Furthermore, the above measuring it made under cathodic protection, and therefore does not permit accurate detection of the polarization width, if the natural potential is fluctuated. Moreover, since the condenser uses thousands or ten thousands of condenser tubes, there exists a problem of difficulty to evaluate the measured polarization resistance, in relation to a variation in the actual conditions of these numerous condenser tubes.

Regardless of whether the heat transfer rate of the condenser tubes are evaluated by the cleanliness factor of the inner tube surfaces or by a value of vacuum or reduced pressure outside the tubes, the obtained measurements are affected by various variables associated with the water vapor introduced into the condenser, for example, humidity, flow condition and amount of air of the vapor stream. Namely, the measured cleanliness factor or vacuum represents that of the condenser as a whole, and never represents the contamination or fouling of the inner surfaces of the condenser tubes. Therefore, the ferrous-ion injection and sponge-ball cleaning based on the obtained measurements will not result in establishing optimum conditions of the tubes. It is also noted that there are differences among the numerous condenser tubes, in the flow rate of the cooling water and the number of the sponge balls passed. Thus, the conventional method tends to suffer from inaccuracy of evaluation of the cleanliness factor of each individual condenser tube.

As described above, the condenser has many factors that make it difficult to achieve accurate detection of the cleanliness factor or vacuum indicative of the heat transfer characteristics of the condenser tubes: variations among the large number of copper alloy condenser tubes, as many as several thousands to several ten thousands, including differences in the flow rate of the coolant, formation of a protective film (iron layer), number of the sponge balls passed, and magnitude of electrolytic potential; and variations in the longitudinal direction of the condenser tubes which may be as long as 20 m or even more. In addition, the condenser tubes are exposed to different conditions of the water vapor at their outer surfaces, and other different environmental factors. All of the above-indicated variables will influence the obtained meaurements of the cleanliness factor or vacuum, lowering the accuracy or reliability of estimation of the heat transfer characteristics of the condenser tubes. Even if the accuracy of the sensing device itself is satisfactory, the conventional monitoring method is not practical for the various factors described above.

SUMMARY OF THE INVENTION

It is therefore an object of the present invention to provide a condenser which is equipped with a ferrous-ion injecting device and a sponge-ball supply device, and which includes means for monitoring the condenser tubes for controlling the above two devices, so as to maintain optimum corrosion resistance and heat transfer characteristics of the condenser tubes.

The above object is achieved by the present invention, which provides a condenser including a body which accommodates a plurality of condenser tubes made of a copper alloy, through which a coolant such as seawater or estuary water is caused to flow, the condenser further including a ferrous-ion injecting device for injecting ferrous ions into the coolant which is passed through the condenser tubes in order to form a protective film on an inner surface of each of the condenser tubes, and a sponge-ball supply device for introducing sponge balls into the condenser tubes for cleaning the inner surfaces of the condenser tubes, the condenser comprises: (a) a by-pass line disposed so as to extend outside the body, in parallel connection with the plurality of condenser tubes in the body, the by-pass line having a monitor tube made of substantially the same material as the condenser tubes and having substantially the same size as the condenser tubes, so that the monitor tube is subjected to a flow of the coolant therethrough under substantially the same conditions as the condenser tubes; (b) polarization-resistance measuring means disposed in an intermediate portion of the monitor tube, for measuring a polarization resistance of the monitor tube; and (c) fouling measuring means disposed in the intermediate portion of the monitor tube, for measuring a condition of fouling of the inner surface of the monitor tube. The ferrous-ion injecting device and the sponge-ball supply device for the condenser tubes in the body of the condenser are adjusted in response to the polarization resistance measured by the polarization-resistance measuring means, and the condition of fouling measured by the fouling measuring means.

In the condenser of the present invention constructed as described above, the monitor tube provided in the by-pass line has substantially the same size as the condenser tubes within the body of the condenser. Therefore, the cooling water introduced into the condenser flows through the monitor tube and the condenser tubes under substantially the same conditions. Thus, the monitor tube acts as a simulator representing the condenser tubes in service in the condenser body. Namely, the conditions of the inner surface of the monitor tube sensed by the polarization-resistance and fouling measuring means, reflect the conditions of the inner surface of the cooling tubes in the condenser body. Hence, it is possible to control the ferrous-ion injecting device and the sponge-ball supply device for the condenser tubes, in response to the information obtained by the measuring means installed on the monitor tube. In this manner, the conditions of the inner surfaces of the condenser tubes of the condenser may be suitably monitored, and controlled as needed according to the results of the monitoring, in order to accurately maintain necessary corrosion resistance and heat transfer characteristics of the condenser tubes. This is an important industrial function provided by the present invention.

According to one feature of the present invention, the body of the condenser has a vapor chamber through which the plurality of condenser tubes extend, and a pair of water chambers disposed on opposite sides of the vapor chamber such that the condenser tubes communicate with the water chambers, and such that the cooling water flows into the condenser tubes through one of the water chambers. The by-pass line is connected at opposite ends thereof with the pair of water chambers.

In one form of the above feature of the invention, the by-pass line has a pair of by-pass water chambers disposed at opposite ends of the monitor tube. The fouling measuring means may consist of a pair of fouling measuring devices one of which is disposed between the polarization-resistance mesuring means and one of the by-pass water chambers, and the other of which is disposed between the polarization-resistance measuring means and the other by-pass water chamber.

In another form of the above feature of the invention, the condenser further comprises an inlet conduit connected to the above-indicated one of the water chambers for introducing the coolant into the one water chamber. The ferrous-ion injecting device and the sponge-ball supply device are associated with the inlet conduit, for injecting the ferrous ions and introducing the sponge balls into the condenser tubes through the inlet conduit.

According to another feature of the invention, the condenser further comprises a second sponge-ball supply device connected to a portion of the by-pass line upstream of the monitor tube. This second sponge-ball supply device is operated concurrently with the sponge-ball supply device for the condenser tubes.

In accordance with another aspect of the invention, there is provided an apparatus for monitoring conditions of inner surfaces of a multiplicity of copper-alloy cooling tubes disposed in a vapor chamber formed in a condenser wherein a coolant such as seawater or estuary water flows thorugh the cooling tubes from one of two water chambers on opposite sides of the vapor chamber, to the other water chamber, the condenser having a ferrous-ion injecting device for injecting ferrous ions into the coolant, which passes through the cooling tubes, in order to form a protective film on an inner surface of each of the cooling tubes, and a sponge-ball supply device for introducing sponge balls into the cooling tubes for cleaning the inner surfaces of the cooling tubes, the apparatus comprising: (a) a by-pass line disposed so as to extend outside the vapor chamber, and connecting the two water chambers, the by-pass line having a monitor tube made of substantially the same material as the coolant tubes and having substantially the same size as the cooling tubes, so that the monitor tube is subjected to a flow of the coolant therethrough under substantially the same conditions as the cooling tubes; (b) polarization-resistance measuring means disposed in an intermediate portion of the monitor tube, for measuring a polarization resistance of the monitor tube; (c) fouling measuring means disposed in the intermediate portion of the monitor tube, for measuring a condition of fouling of the inner surface of the monitor tube; and (d) means for controlling the ferrous-ion injecting device and the sponge-ball supply device for the cooling tubes in the body of the condenser, based on the polarization resistance measured by the polarization-resistance measuring means, and/or the condition of fouling measured by the fouling measuring means, for forming the protective film on the inner surface of the cooling tubes, and/or cleaning the inner surface of the cooling tubes with the sponge balls.

BRIEF DESCRIPTION OF THE DRAWINGS

The above and optional objects, features and advantages of the present invention will be better understood by reading the following detailed description of a preferred embodiment of the invention, when considered in connection with the accompanying drawings, in which:

FIG. 3(*b*) is an explanatory view showing another form of a polarization-resistance measuring device;

FIG. 3(*c*) is a view partly in cross section taken along line III—III of FIG. 3(*b*);

DETAILED DESCRIPTION OF THE PREFERRED EMBODIMENT

To further clarify the concept of the present invention, a preferred embodiment of the invention will be described in detail by reference to the accompanying drawings.

Figure 1:
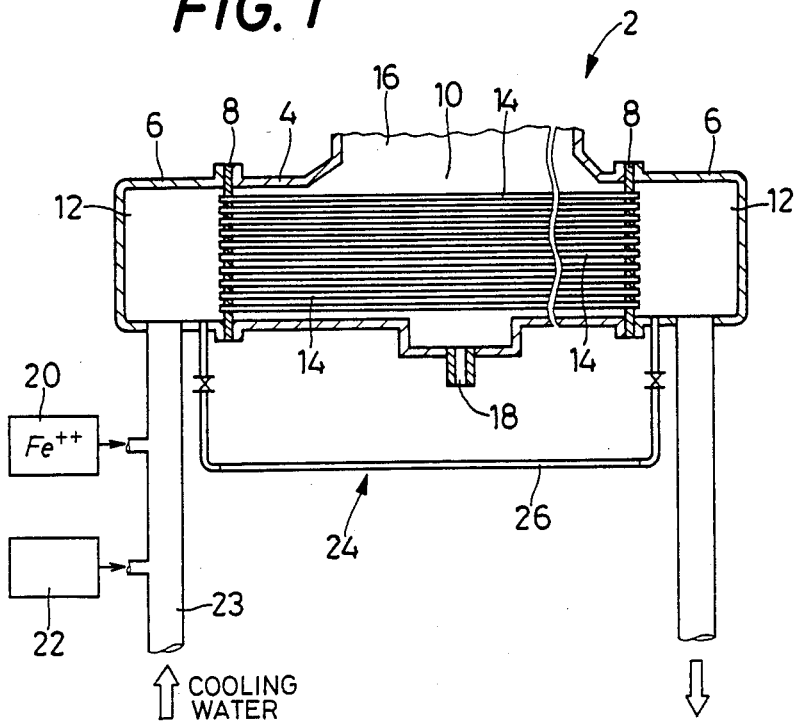
FIG. 1 is a schematic explanatory view showing a condenser equipped with a corrosion-fouling monitor tube, according to one embodiment of the present invention.

Referring first to the schematic view of FIG. 1, there is illustrated an overall arrangement of a condenser equipped with a monitor tube connected thereto, according to one preferred embodiment of the invention. The condenser, which is indicated generally at 2 in the figure, has a relatively large-size shell 4, and a pair of closure members (water chamber covers) 6 which are disposed on the opposite open ends of the shell 4, so that the shell 4 and the closure members 6 cooperate to define a fluid-tight enclosed space. This space within the shell 4 and the closure members 6 is divided by two opposed tube plates 8 into an intermediate vapor chamber 10, and a pair of water chambers 12, 12 disposed on the opposite sides of the vapor chamber 10. The condenser 2 has a multiplicity of cooling tubes (condenser tubes) 14 made of a copper alloy, which extend through the vapor chamber 10 between the two tube plates 8, such that the cooling tubes 14 are supported at their opposite longitudinal ends by the two tube plates 8, 8, respectively.

The condenser 2 is adapted so that a coolant such as seawater is introduced into one of the two water chambers 12 (the upstream water chamber) and flows through the cooling tubes 14 to the other water chamber 12 (the downstream water chamber). The condenser shell 4 has a vapor inlet 16 formed in an upper portion thereof so that water vapor can pass through the vapor inlet 16 into the vapor chamber 10. The vapor in the vapor chamber 10 is brought into contact with the outer surface of the cooling tubes 14 through which the cooling water is caused to flow, whereby the water vapor is condensed into its liquid phase. Thus, the introduced fluid in the vapor phase is reduced into a condensate, which is discharged through a condensate outlet 18 provided in a lower portion of the condenser shell 4.

The condenser 2 is equipped with a ferrous-ion injecting device 20 and a sponge-ball supply device 22, which are connected to an inlet conduit 23 communicating with the upstream water chamber 12. The ferrous-ion injecting device 20 is adapted to inject ferrous ions into the coolant passing through the inlet conduit 23 (and subsequently through the cooling tubes 14), in order to form a protective film on the inner surface of each cooling tube 14. The sponge-ball supply device 22 is adapted to introduce suitable sponge balls into the cooling tubes 14, for removing a slime layer deposited on the inner surface of the cooling tubes 14, i.e., for cleaning the inner surface of the tubes 14.

Generally, a water-soluble iron compound such as ferrous sulfate is employed to add ferrous ions to the coolant by the injecting device 20, so that the concentration of the ferrous ions introduced in the coolant as a result of dissolution of the ion compound is held within the range of from 0.03–0.5 ppm. The lower limit of 0.03 ppm is the minimum concentration that will provide an effective protective film or layer on the inner surface of the cooling tubes 14. If a concentration greater than 0.5 ppm is used, the discharged coolant presents environmental pollution problems. The sponge-ball supply device 22 may use conventional cleaning sponge balls, which generally have diameters about 2 mm larger than the inside diameter of the cooling tubes 14. These sponge balls are introduced into the inlet conduit 23, in a suitable number for each cleaning cycle. The introduced sponge balls are fed with the coolant into the cooling tubes 14, for cleaning the inner surface of the tubes 14 while the balls are passed through the tubes 14.

The condenser 2 is further equipped with a by-pass line generally indicated at 24 in FIG. 1. The by-pass line 24 is disposed outside the body of the condenser 2 (outside the condenser shell 4), so as to connect the upstream and downstream water chambers 12, 12, in parallel connection with the cooling tubes 14. The condenser 2 is adapted so that the same coolant as introduced into the cooling tubes 14 is caused to flow through the by-pass line 24 under the same flow conditions. The by-pass line 24 includes a monitor tube 26 which is made of substantially the same material (copper alloy) as the cooling tubes 14, and which has substantially the same dimensions (length, outside diameter and wall thickness) as the cooling tubes 14. Thus, the monitor tube 26 is exposed to a flow of the coolant under the same conditions as the cooling tubes 14 in the vapor chamber 10.

Figure 2:
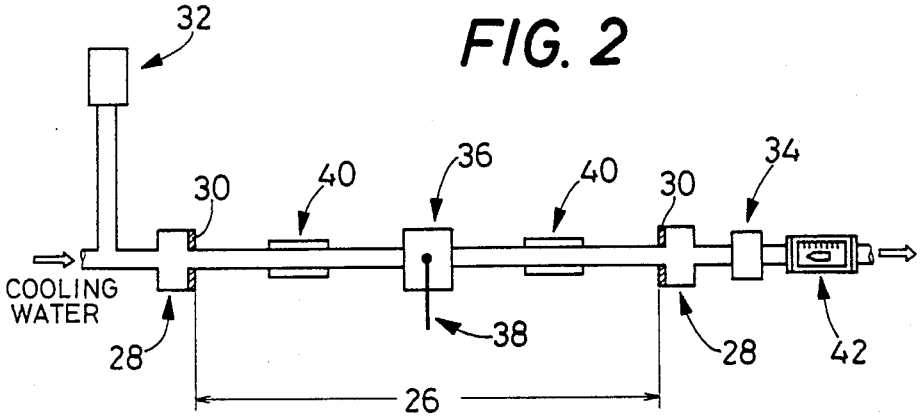
FIG. 2 is a view showing an arrangement of various instruments or devices attached to the monitor tube.

As shown in FIG. 2, the monitor tube 26 connected in the by-pass line 24 is provided at its opposite ends with a pair of by pass water chambers 28 and a corresponding pair of by pass tube plates 30, so that the monitor tube 26 may function as a simulator to the cooling tubes 14. For the same purpose, a sponge-ball supply device 32 is provided to introduce sponge balls into the monitor tube 26 through an upstream portion of the by-pass line 24. This supply device 32 is adapted to be operated at the same time and under the same operating conditions, as the sponge-ball supply device 22 for the cooling tubes 14, for cleaning the inner surface of the monitor tube 26 under the same conditions as the cooling tubes 14 are cleaned. For example, the cleaning operations of the cooling tubes 14 and the monitor tubes 26 are effected two times a week, with 5 or 6 sponge balls introduced in a 30-minute period for each of the two cleaning cycles per week. The sponge balls used for cleaning the monitor tube 26 are received by a recovery device 34 provided at a downstream portion of the by-pass line 24.

At a substantially middle portion of the monitor tube 26 in the longitudinal direction, there is formed an intermediate water chamber 36 in which is disposed a suitable polarization-resistance measuring device 38 for monitoring the polarization resistance of the monitor tube 26. While the intermediate water chamber 36 and the measuring device 38 are located in the middle of the monitor tube 26 in the present embodiment, they may be located at other positions along the length of the monitor tube 26. Between the intermediate water chamber 36 and the by-pass water chambers 28, 28 at the opposite ends of the monitor tube 26, there are disposed two fouling measuring devices 40, 40 which serve as means for measuring a physical value indicative of the condition of fouling or contamination of the inner surface of the monitor tube 26. For assuring the same rate of flow of coolant through the monitor tube 26 as that through the cooling tubes 14 in the vapor chamber 10, a flow meter 42 is provided to monitor the rate of flow of the coolant through the monitor tube 26.

Various known devices may be used as the polarization-resistance measuring device 38 for the monitor tube 26. For example, either one of two measuring devices illustrated in FIG. 3(*a*) and FIGS. 3(*b*) and 3(*c*) may be utilized as needed. The polarization-resistance measuring device shown in FIG. 3(*a*) uses a potentiostat 44 for cathodically polarizing the monitor tube 26. The polarization resistance R ($\Omega$ cm$^2$) of the monitor tube 26 is obtained according to the Equation (1) given below. In this measuring device, a vinyl chloride insulating pipe 46 which connects separate parts of the monitor tubes 26 supports an anode 48 (e.g., Ag-Pb electrode) and a reference electrode 50 (Zn electrode). The monitor tube 26 serves as a sample electrode 52.

$$R=(E_0/I_0)^2\,(2\pi^2a^3/\rho) \qquad (1)$$

where, $E_0$=difference (mV) between electrolytic and natural potentials: usually, 200 mV approx.

Figure 3A:
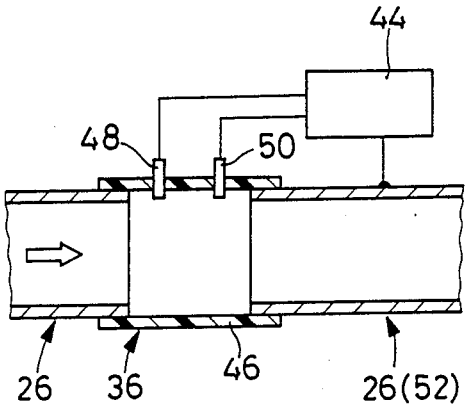
FIG. 3(*a*) is an explanatory view showing one form of a polarization-resistance measuring device attached to the monitor tube.
Figure 3B:
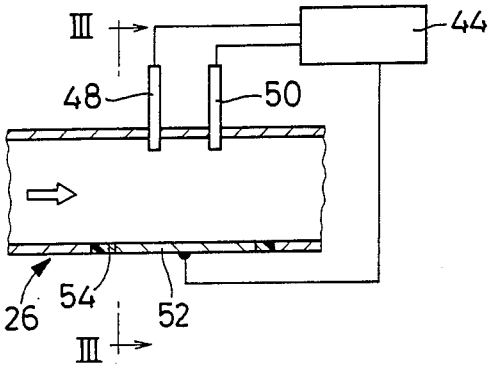
Figure 3C:
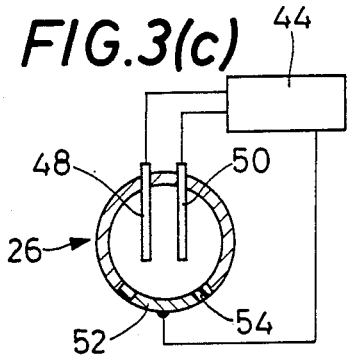

$I_0$=current (mA) per cooling tube, with the above potentials a=inside diameter (cm) of cooling tubes $\rho$=resistivity ($\Omega$ cm) of cooling water Another measuring device shown in FIGS. 3(*b*) and 3(*c*) is almost similar to that of FIG. 3(*a*) in the basic arrangement, but is different in that the anode 48 (e.g., Pb-Ag electrode) is positioned opposite to a sample electrode 52 which is a small part of the monitor tube 26 separated from the remaining part of the same by vinyl chloride insulator means 54. The anode 48 and the reference electrode 50 are disposed movably so as to extend into the interior of the monitor tube 26 in a fluid-tight manner, as indicated in FIG. 3(*c*), when the monitor tube 26 is not in a cleaning process by sponge balls.

Figure 4:
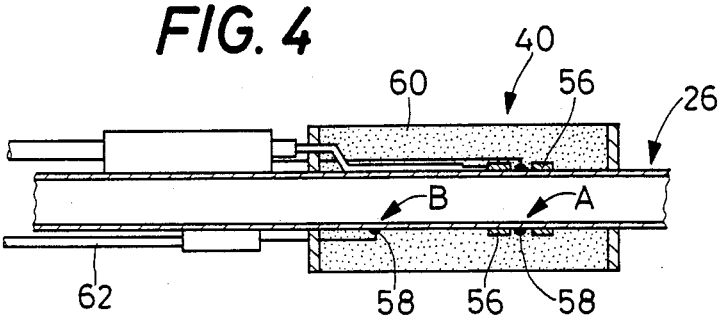
FIG. 4 is an explanatory view showing one form of a fouling measuring device attached to the monitor tube.

The fouling measuring devices 40, 40 for sensing the condition of fouling of the monitor tube 26 may be suitably arranged as known in the art. In the present embodiment, each fouling measuring device 40 is arranged as shown in FIG. 4, wherein heaters 56 of 50–150W capacity are used to heat the adjacent wall portions of the monitor tube 26. The temperature of the wall of the thus heated monitor tube 26 is measured at Points A and B by respective CA thermocouples 58. Point A is at the center of the heated portion of the tube 26, while Point B is spaced from Point A by a distance enough to avoid an influence of the heat generated by the heaters 56. While the temperature is measured, flow rate of the coolant is precisely measured by the flow meter 42 (FIG. 2). The degree of contamination or fouling of the inner surface of the monitor tube 26, and therefore that of the cooling tubes 14, may be obtained based on the difference between the temperatures measured at Points A and B, and according to a predetermined relationship between the temperature difference and a fouling factor. Reference numerals 60 and 62 in FIG. 4 indicate an adiabator and electric leads.

In the condenser 2 wherein the monitor tube 26 equipped with the above-described various devices is connected in the external by-pass line 24 parallel to the internal cooling tubes 14, the condition of the inner surfaces of the cooling tubes 14 and its change can be exactly estimated by monitoring the polarization resistance and the fouling condition of the monitor tube 26 by means of the measuring devices 38 and 40, 40, since the same conditions of flow of the cooling water through the monitor tube 26 and the cooling tubes 14 should establish substantially the same conditions of the inner surfaces of the monitor tube 26 and the cooling tubes 14. Based on the measured polarization resistance and the detected fouling condition of the monitor tube 26, the ferrous-ion injecting device 20 and the sponge-ball supply device 22 for the cooling tubes 14 are operated, to inject ferrous ions to form an anti-corrosion or protective film on the inner surface of the cooling tubes 14, and clean the fouled inner surface with the sponge balls which are passed through the tubes 14. Thus, the inner surfaces of the cooling tubes 14 are protected against corrosion, while the heat transfer rate is improved.

Since the monitor tube 26 is provided in the by-pass line 24, the position of the polarization-resistance measuring device 38 is not unfavorably limited to the end portions of the monitor tube 26, but may be suitably selected at a longitudinal central portion of the tube. This makes it possible to exactly estimate the condition of the cooling tubes 14 even when the tubes 14 are considerably long. Further, the above arrangement permits precise evaluation of the corrosion resistance of the cooling tubes 14, without an influence by the tube plates and cathodic protection.

In the present arrangement, the cleanliness factor of the inner surface of the cooling tubes 14 which reflects the heat transfer characteristics may be represented by the condition of the inner surface of the monitor tube 26. Consequently, changes in the heat transfer characteristics of the cooling tubes 14 can be exactly estimated by monitoring the fouling condition of the inner surface of the monitor tube 26. Thus, the instant arrangement is effective to prevent deterioration of the heat transfer rate or other problems of the cooling tubes 14 due to excessive or insufficient cleaning with sponge balls.

In summary, the operations of the ferrous-ion injecting device 20 and the sponge-ball supply device 22 can be suitably controlled, based on exact information on the conditions of the inner surface of the cooling tubes 14, which information is obtained from the polarization-resistance and fouling measuring devices 38, 40 attached to the monitor tube 26. Hence, it is possible to effect suitably controlled injection of ferrous ions into the cooling tubes 14 to form protective films on their inner surfaces, and suitably controlled cleaning of the inner surfaces of the tubes 14 with sponge balls.

The advantages of the present invention described above will be better understood from the results of the following experiment. However, it is to be understood that the present invention is not limited to the details of the experiment and the preferred embodiment shown and illustrated above, but may be embodied with various changes, modifications and improvements which may occur to those skilled in the art, in light of the foregoing and following teachings, without departing from the spirit of the present invention.

EXPERIMENT

Vinyl chloride pipes were connected to air bleeder valves provided at the upstream and downstream (inlet and outlet) water chambers of a condenser installed in a plant on site. Between these vinyl chloride pipes was connected a new tube (JIS-H3300-C6871) which has the same specifications as the cooling tubes used in the condenser (outside diameter: 25.4 mm, wall thickness: 1.24 mm, length: 15 m, made of aluminum brass). Similarly, one of the used cooling tubes removed from the condenser was connected between the vinyl chloride pipes. Each of these new and used tubes was used as the monitor tube 26. The monitoring devices as shown in FIG. 2 were attached to each of the new and used tubes, in the manner as shown in the figure. As polarization-resistance and fouling measuring devices, those shown in FIGS. 3(*a*) and 4, respectively were employed. The sponge-ball supply device 32 shown in FIG. 2 was used to introduce sponge balls into the new and used monitor tubes 26, at the same time as the sponge-ball supply device for the condenser was operated to effect the sponge-ball cleaning of the cooling tubes of the condenser. The sponge-ball cleaning of the monitor tubes 26 and the condenser's cooling tubes was performed once a week, with four sponge balls for each cleaning operation. Further, ferrous ions were injected at a rate of 0.3 ppm into the cooling water through the upstream water chamber of the condenser, three times a week, for three hours for each injection.

Figure 5A:
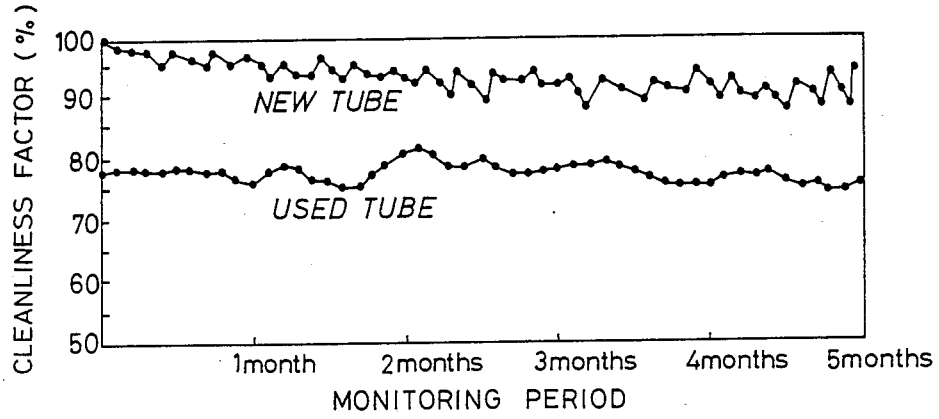
FIG. 5(*a*) and FIG. 5(*b*) are graphs representing changes in cleanliness factor and polarization-resistance of a monitor tube measured during a monitoring period.
Figure 5B:
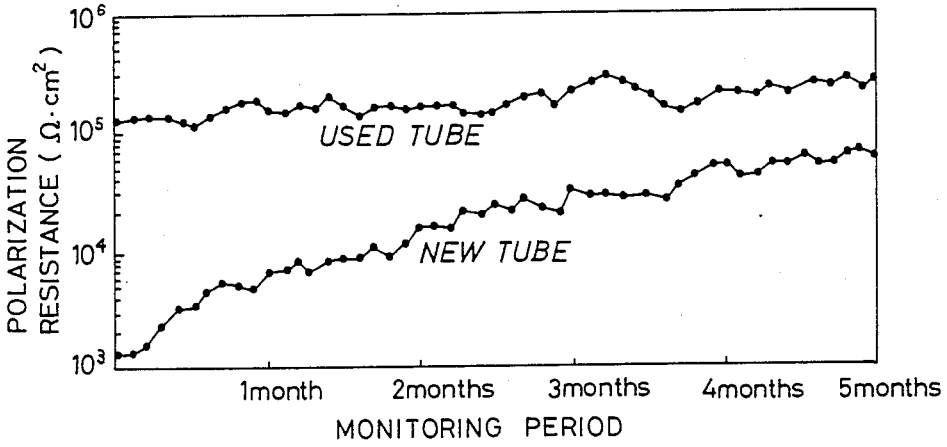

In the above manner, the condenser was operated for five months, while the conditions of the monitor tubes 26 were monitored by the measuring devices. The results of the monitoring are represented in FIGS. 5(*a*) and 5(*b*). As seen in the graphs in these figures, considerable changes in the cleanliness factor and polarization resistance were not observed on the used monitor tube. Namely, the cleanliness factor was held at about 75%, while the polarization resistance was held around 150,000–250,000 $\Omega$ cm$^2$. On the other hand, the new monitor tube had a decline of its cleanliness factor down to about 90% level. However, the cleanliness factor was raised up to about 95% level as a result of each sponge-ball cleaning operation, as clearly shown in the graph of FIG. 5(*a*). The polarization resistance of the new monitor tube was gradually increased with the monitoring time, to the final level of 50,000 $\Omega$ cm$^2$ at the end of the five-month monitoring period.

The above results of monitoring indicate that the protective films formed on the inner surface of the cooling tubes of the condenser in service grew to an excessive extent, and that the cleanliness of the cooling tubes was lower than the predetermined lower limit (85%). Thus, the monitoring results recommended to increase the frequency of the sponge-ball cleaning operations. At the same time, the results show that the ferrousion-ion injection into the cooling seawater formed a good protective film on the inner surface of each cooling tube in the condenser.

What is claimed is:

1. A condenser including a body which accommodates a plurality of condenser tubes made of a copper alloy, through which a coolant is caused to flow, the condenser further including a ferrous-ion injecting device for injecting ferrous ions into the coolant before it passes through the condenser tubes in order to form a protective film on an inner surface of each of the condenser tubes, and a first sponge-ball supply device for introducing sponge balls into the condenser tubes for cleaning the inner surfaces of the condenser tubes, comprising:

a by-pass line disposed so as to extend outside said body, in parallel connection with said plurality of condenser tubes in said body, said by-pass line having a monitor tube made of substantially the same material as said condenser tubes and having substantially the same size as said condenser tubes, so that coolant, ferrous ions and sponge balls are caused to flow through said monitor tube under substantially the same operating conditions as in said condenser tubes, said by-pass line having a pair of by-pass water chambers disposed at opposite ends of said monitor tube;

polarization-resistance measuring means disposed in an intermediate portion of said monitor tube, for measuring a polarization resistance of said monitor tube; and fouling measuring means disposed in said intermediate portion of said monitor tube, for measuring a condition of fouling of the inner surface of said monitor tube, said fouling measuring means consisting of a pair of fouling measuring devices one of which is disposed between said polarization-resistance measuring means and one of said by-pass water chambers, and the other of which is disposed between said polarization-resistance measuring means and the other by-pass water chamber;

said body having a vapor chamber through which said plurality of condenser tubes extend, and first and second water chambers disposed on opposite sides of said water chamber such that said condenser tubes communicate with said water chambers, and such that said coolant flows into said condenser tubes through said first water chamber, said by-pass line being connected at opposite ends thereof with said pair of water chambers;

whereby said ferrous-ion injecting device and said first sponge-ball supply device for said condenser tubes in said body of the condenser may be adjusted in response to the polarization resistance measured by said polarization-resistance measuring means and the condition of fouling measured by said fouling measuring means.

2. A condenser according to claim 1, further comprising an inlet conduit connected to said first water chamber for introducing said coolant into said first water chamber, said ferrous-ion injecting device and said first sponge-ball supply device being associated with said inlet conduit.

3. A condenser according to claim 1, further comprising a second sponge-ball supply device connected to a portion of said by-pass line upstream of said monitor tube.

4. An apparatus for monitoring conditions of inner surfaces of a multiplicity of copper-alloy cooling tubes disposed in a vapor chamber formed in a condenser wherein a coolant flows through the cooling tubes from a first of two water chambers positioned on opposite sides of said vapor chamber, to the second water chamber, said condenser having a ferrous-ion injecting device for injecting ferrous ions into the coolant before it passes through the cooling tubes in order to form a protective film on an inner surface of each of the cooling tubes, and a first sponge-ball supply device for introducing sponge balls into the cooling tubes for cleaning the inner surfaces of the cooling tubes, said apparatus comprising:

a by-pass line disposed so as to extend outside said vapor chamber, and communicating with said first and second water chamber, said by-pass line having a monitor tube made of substantially the same material as said cooling tubes and having substantially the same size as said cooling tubes, so that coolant, ferrous ions and sponge balls flow through said monitor tube under substantially the same conditions as in said cooling tubes, said by-pass line also having first and second by-pass chambers at opposite ends of said monitor tube;

polarization-resistance measuring means disposed in an intermediate portion of said monitor tube, for measuring a polarization resistance of said monitor tube; and fouling measuring means consisting of a pair of fouling measuring devices, one of which is disposed between said polarization-resistance measuring means and said first by-pass water chamber, and the other of which is disposed between said polarization-resistance measuring means and said second by-pass water chamber, said fouling measuring means measuring a condition of fouling of the inner surface of said monitor tube, whereby said ferrous-ion injecting device and said sponge-ball supply device may be adjusted in response to the polarization resistance measured by said polarization-resistance measuring means and the condition of fouling meausured by said fouling measuring means.

5. An apparatus according to claim 4, further comprising a second sponge-ball supply device connected to a portion of said by-pass line upstream of said pair of by-pass water chambers, for introducing sponge balls into said monitor tube, said second sponge-ball supply device being operated simultaneously with said first sponge-ball supply device.

* * * * *